US009598201B2

(12) United States Patent
Boukobza et al.

(10) Patent No.: US 9,598,201 B2
(45) Date of Patent: Mar. 21, 2017

(54) CONTAINER COMPRISING AN ARCHED BASE HAVING A STAR-SHAPED CROSS-SECTION

(71) Applicant: SIDEL PARTICIPATIONS, Octeville sur Mer (FR)

(72) Inventors: Michel Boukobza, Octeville sur Mer (FR); Laurent Penet, Octeville sur Mer (FR)

(73) Assignee: SIDEL PARTICIPATIONS, Octoeville Sur Mer (FR)

( * ) Notice: Subject to any disclaimer, the term of this patent is extended or adjusted under 35 U.S.C. 154(b) by 0 days.

(21) Appl. No.: 14/374,699

(22) PCT Filed: Apr. 10, 2013

(86) PCT No.: PCT/FR2013/050773
§ 371 (c)(1),
(2) Date: Jul. 25, 2014

(87) PCT Pub. No.: WO2013/156710
PCT Pub. Date: Oct. 24, 2013

(65) Prior Publication Data

US 2015/0136725 A1 May 21, 2015

(30) Foreign Application Priority Data

Apr. 17, 2012 (FR) ..... 12 53543

(51) Int. Cl.
*B65D 8/04* (2006.01)
*B65D 1/02* (2006.01)

(52) U.S. Cl.
CPC ..... *B65D 1/0276* (2013.01)

(58) Field of Classification Search
CPC .... B65D 1/0261; B65D 1/44; B65D 21/0231; B29C 49/54
USPC ..... 220/608; 215/373
See application file for complete search history.

(56) References Cited

U.S. PATENT DOCUMENTS 4,525,401 A 6/1985 Pocock et al.
4,620,639 A * 11/1986 Yoshino ..... B29C 49/0078 215/373
5,236,097 A 8/1993 Behm et al.
5,503,283 A * 4/1996 Semersky ..... B65D 1/0276 215/375

(Continued)

FOREIGN PATENT DOCUMENTS

EP 1 069 983 A1 1/2001
JP 8-133260 A 5/1996

OTHER PUBLICATIONS

International Search Report for PCT/FR2013/050773 dated Jun. 6, 2013 [PCT/ISA/210].

*Primary Examiner* — Shawn M Braden
(74) *Attorney, Agent, or Firm* — Sughrue Mion, PLLC

(57) ABSTRACT

A container of plastic material, having a body extending along a principal axis and a bottom in the extension of the body at a lower end thereof. The bottom has an annular seat defining a seating plane; and a conical arch that extends from near the seat towards the interior of the container to a central apex, the arch having in transverse cross-section a star-shaped profile inscribed between two circles, the ratio of the diameters of which is greater than or equal to 0.7.

14 Claims, 5 Drawing Sheets

(56) References Cited

U.S. PATENT DOCUMENTS

| | | | | |
|---|---|---|---|---|
| 6,634,517 | B2 * | 10/2003 | Cheng | B65D 1/0276 215/371 |
| 8,127,955 | B2 * | 3/2012 | Denner | B65D 79/005 215/373 |
| 8,548,879 | B2 * | 10/2013 | Shiner | G06Q 10/087 705/28 |

* cited by examiner

FIG.5
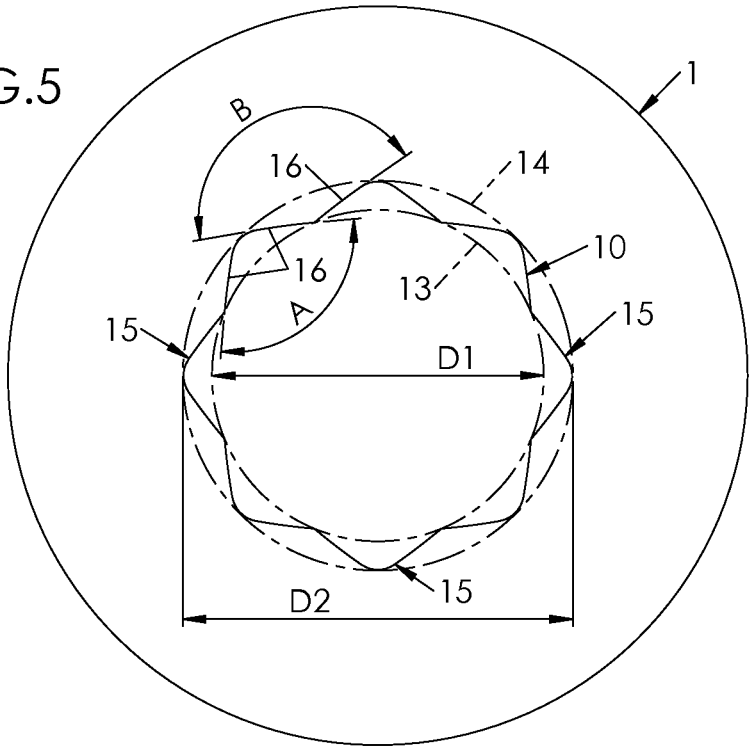
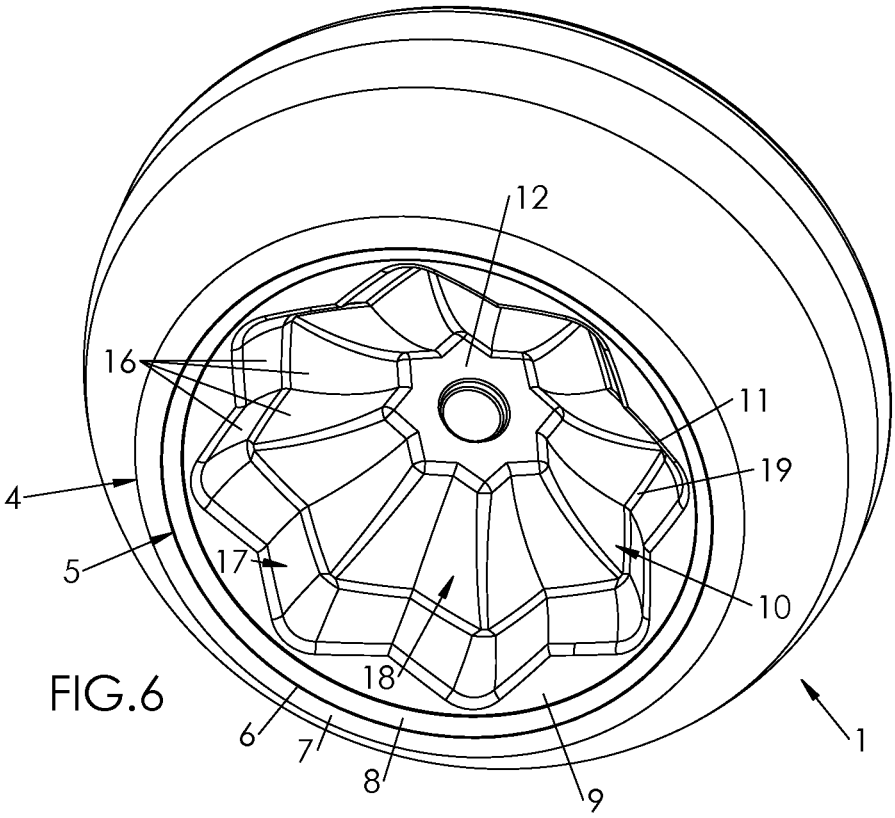
FIG.6

CONTAINER COMPRISING AN ARCHED BASE HAVING A STAR-SHAPED CROSS-SECTION

CROSS REFERENCE TO RELATED APPLICATIONS

This application is a National Stage of International Application No. PCT/FR2013/050773, filed on Apr. 10, 2013, which claims priority from French Patent Application No. 1253543, filed on Apr. 17, 2012, the contents of all of which are incorporated herein by reference in their entirety.

The invention concerns containers obtained by blow molding or stretch blow molding from blanks (preforms or intermediate containers having undergone one or more previous blow molding operations) made of plastic material.

Manufacturing a container by blow molding comprises a step of inserting, into a mold having the impression of the container, a blank previously heated to a temperature above the glass transition temperature of the material of which the preform is made (such as PET), and a step of injecting into the blank a fluid (such as air) under pressure. Stretching by means of a sliding rod can complete the blow molding.

This technique has long been known. It is also recognized that the double molecular orientation (axial and radial) that the material undergoes during blow molding or stretch blow molding is sometimes too weak to reliably give the container sufficient mechanical strength. This lack of strength particularly affects the bottom of the container, which undergoes significant dynamic stresses (during filling) and static stresses (after filling, just from the pressure of the contents).

It is known that the bottom of a container can be rigidified by giving it a hollow shape defining an arch intended to withstand the aforementioned stresses. Since just the presence of such an arch can prove to be insufficient, it has even been proposed to rigidify it by means of radial ribs, see for example American U.S. Pat. No. 4,525,401.

However, this structure assumes that extra material must be allocated to the bottom because of the excess thicknesses created by the ribs. The result is an increase in the mass of the container, contrary to current trends of economizing material.

Another result is difficulties in blowability ("blowability" is the capability of the container to be formed by blow molding, i.e., the capability of the material to be properly impressed into the mold), because the thickness of the material makes it difficult for it to flow into the impressions of the mold corresponding to the ribs.

An ordinary solution can then consist of increasing the blowing pressure, but this solution requires increasing the capacities of the pneumatic injection system, to the detriment of the energy balance of the manufacturing process.

Another solution consists of pressing the constituent material of the bottom of the container by using—among other things—a special mold equipped with a mold bottom that is movable in translation that pushes the material (in particular, see European patent EP 1 069 983). The pushing results in an increase in the rate of deformation of the material and thus a mechanical increase in its crystallinity, the pushing phase conferring the final shape on the bottom of the container.

However, this technique—called "boxing"—does not guarantee that the rigidity of the bottom will be sufficient and does not exempt manufacturers from using special shapes that remain subject to blowability limitations.

Consequently, there remains a need to propose shapes that can confer to the bottom a good compromise between blowability and structural rigidity (particularly for withstanding deformations induced by excess pressure in the container, typically when the contents are a carbonated beverage).

In order to meet this need, a container of plastic material is proposed, comprising a body extending along a principal axis and a bottom in the extension of the body at a lower end thereof, the bottom comprising:

- an annular seat defining a seating plane;
- a conical arch that extends from near the seat towards the interior of the container to a central apex, said arch having in transverse cross-section a star-shaped profile inscribed between two circles, the ratio of the diameters of which is greater than or equal to 0.7.

Said bottom offers both good structural rigidity and good blowability, while not requiring excess material, to the benefit of the lightness of the container.

Various additional characteristics can be foreseen, alone or in combination:

- the ratio of the diameters is between 0.8 and 0.9;
- the arch comprises a series of facets defining angles between them that are obtuse in a transverse plane;
- the angles between facets are greater than or equal to 100°;
- the arch has two superimposed portions, i.e., a lower substantially conical portion at an acute angle, which extends from near the seat to an intermediate junction zone, and an upper substantially conical section at an obtuse angle, which extends from the intermediate junction zone to the apex;
- the lower portion and the upper portion of the arch have axial extensions that are equal or practically equal;
- the lower portion of the arch has, in axial cross-section, a curved profile with concavity turned towards the axis of the container;
- the upper portion of the arch has, in axial cross-section, a curved profile with concavity turned opposite to the axis of the container;
- in axial cross-section, the profiles of the lower portion and the upper portion have respective radii of curvature R1 and R2 such that the ratio R2/R1 falls between 0.6 and 1;
- the arch has a height H measured axially and the seat has a width d measured transversely, the ratio H/d of these dimensions being greater than 0.25.

Other objects and advantages of the invention will be seen from the description provided below of a preferred embodiment, with reference to the appended drawings in which:

FIG. 5 is a cross-section along cutting plane V-V of FIG. 4;

FIG. 6 is a view similar to FIG. 2, illustrating a container bottom according to a second embodiment;

Figure 1:
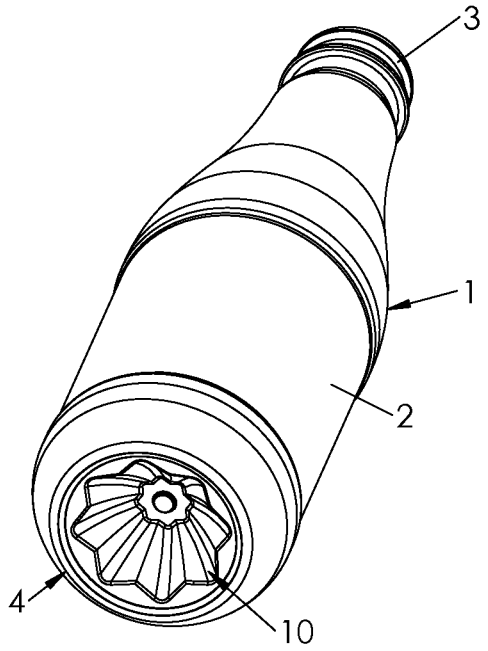
FIG. 1 is a view in perspective from below of a container of plastic material according to a first embodiment.
Figure 2:
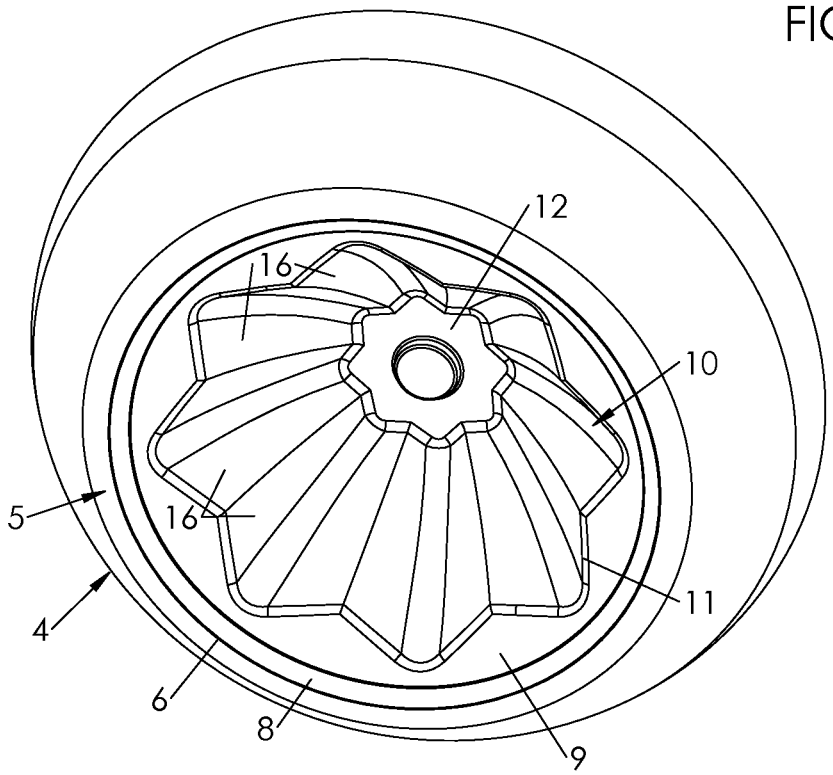
FIG. 2 is a view in perspective, in larger scale, of the bottom of the container of FIG. 1.

Represented in FIG. 1 is a container 1 produced by stretch blow molding from a preform of thermoplastic material such as PET (polyethylene terephthalate).

Said container 1 comprises a body 2 generally cylindrical in shape around a principal axis X. The body 2 is extended at an upper end by a neck 3 forming a rim and, at a lower end, by a bottom 4.

The bottom 4 comprises a seat 5 in the form of an annular flange (toric in this instance) that extends in the extension of the body 2 and terminates axially by a continuous annular face that forms the lower end of the container and defines a seating plane 6 perpendicular to the axis X of the container 1, by which said container can rest stably on a flat surface such as a table.

Figure 3:
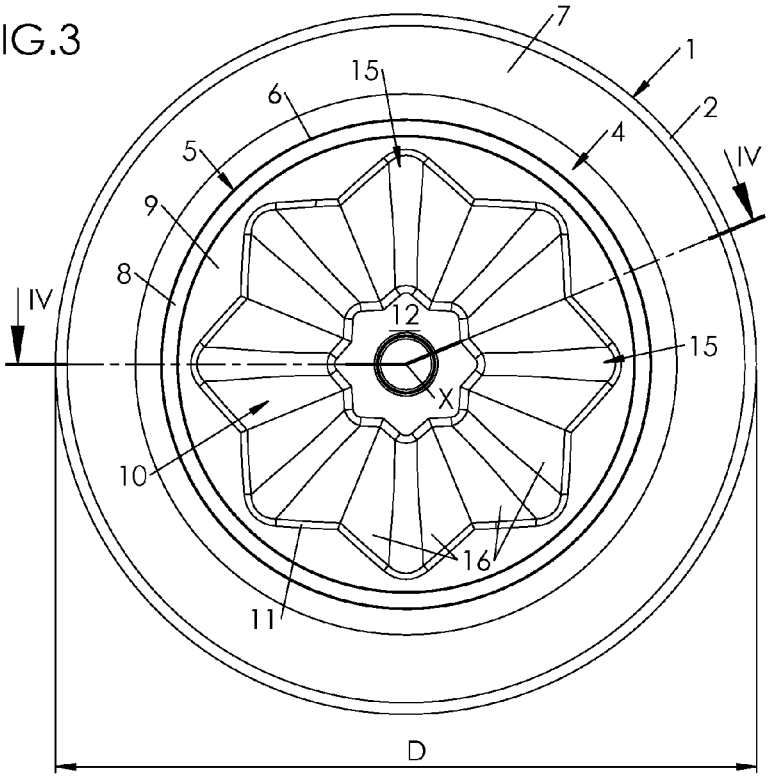
FIG. 3 is a plan view from below of the bottom of FIG. 2.

As can be seen in FIG. 3, D denotes the overall width, measured transversely, of the body 2. When the body 2 is symmetrical of revolution, said overall width D corresponds to a diameter. The seating plane 6 is perpendicular to the axis X of the container 1.

Figure 4:
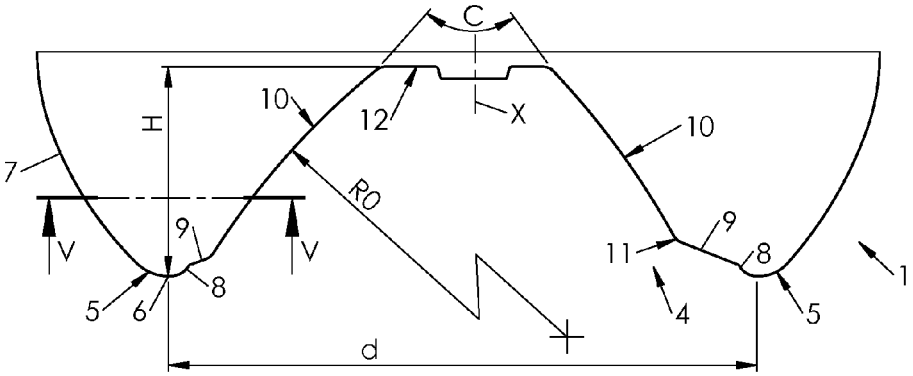
FIG. 4 is a cross-section of the bottom of the container of the preceding figures, along cutting plane IV-IV of FIG. 3.
Figure 7:
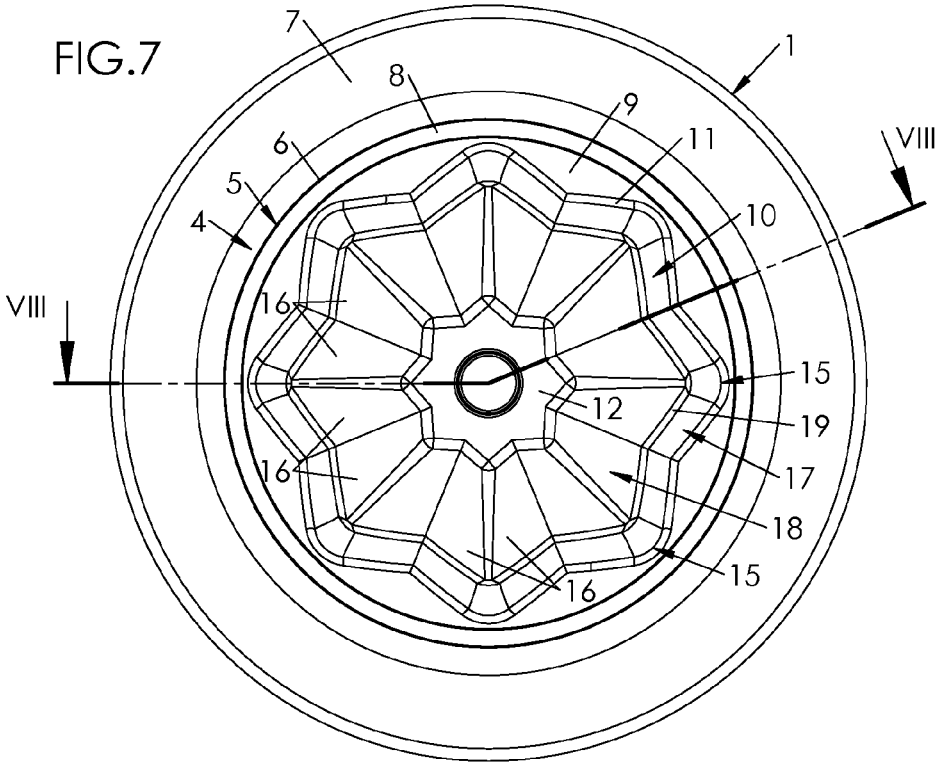
FIG. 7 is a plan view from below of the bottom of FIG. 6.
Figure 8:
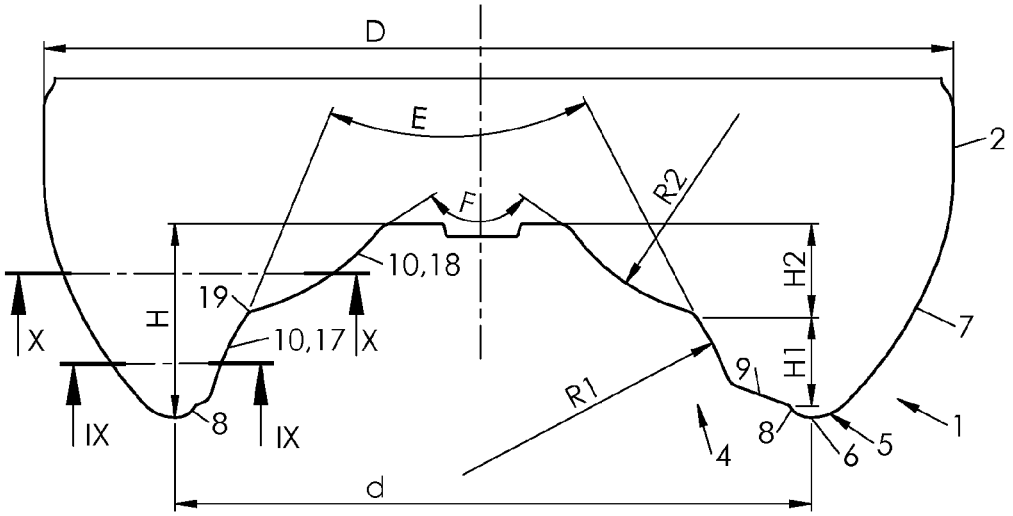
FIG. 8 is a cross-section along cutting plane VIII-VIII of FIG. 7.

As shown in FIGS. 4 and 8, the seating plane 6 extends radially over a width denoted as d, which, in the examples illustrated where the container 1 is symmetrical of revolution, corresponds to a diameter. The seat 5 is connected externally to the body 2 by a large-radius fillet 7. The diameter d of the seating plane 6 and the overall diameter D of the body are preferably in a ratio of between 0.65 and 0.9. In the illustrated example, this ratio is about 0.7:

$$\frac{d}{D} \cong 0.7$$

Towards the interior of the container 1, the seat 5 is connected, by an annular cheek 8 in the form of a small-radius fillet, to a conical membrane 9 at an open angle to the apex (in the illustrated examples, said angle is about 135°) and having a small radial extension.

The bottom 4 further comprises a conical arch 10 that extends from an inner edge 11 of the membrane 9 towards the interior of the container 1, to a central apex 12. From the inner edge 11 of the membrane 9 (which remains near the seat 5 because of the small radial extension of the membrane 9) to the apex 12, the arch 10 has a star-shaped profile in transverse cross-section (perpendicular to the axis).

Figure 9:
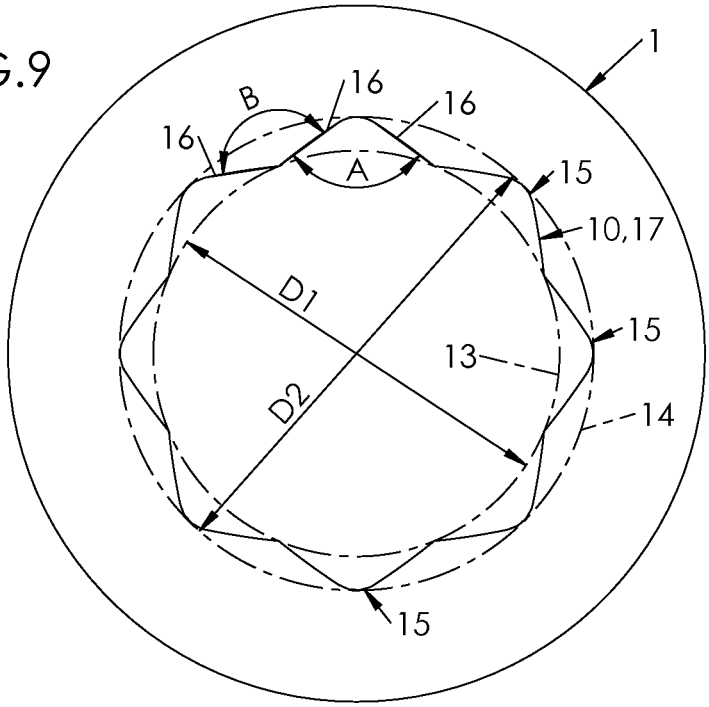
FIG. 9 is a cross-section along cutting plane IX-IX of FIG. 8.
Figure 10:
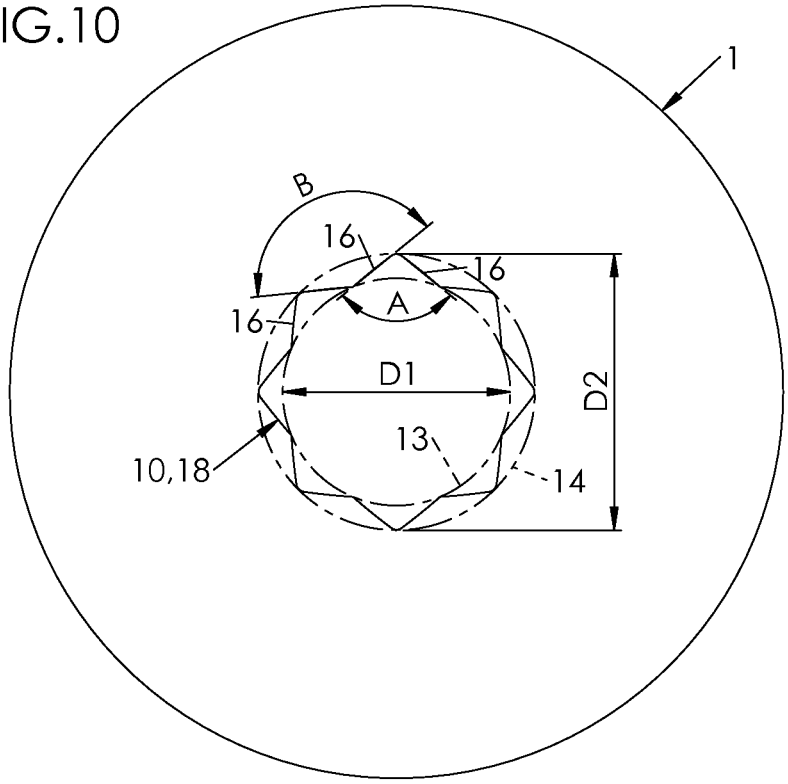
FIG. 10 is a cross-section along cutting plane X-X of FIG. 8.

As can be seen in FIGS. 5, 9 and 10, said star-shaped profile is inscribed between an inner circle 13 (virtual) and an outer circle 14 (virtual) having respective diameters D1 and D2, the ratio of which is greater than or equal to 0.7. According to a preferred embodiment illustrated in the figures, said ratio falls between 0.8 and 0.9:

$$\frac{D1}{D2} \geq 0.7$$

And preferably:

$$0.8 \leq \frac{D1}{D2} \leq 0.9$$

In other words, the star formed by the profile (in transverse cross-section) of the arch 10 has branches 15, the radial extension of which is small with respect to the overall radius (or diameter) of the star.

The arch 10 thus comprises a series of facets 16, which, grouped in pairs, define the branches 15 of the star. The angles between the facets 16 of the same branch 15, and between two adjacent facets 16 of two neighboring branches 15, measured in a transverse plane and denoted respectively A and B (FIG. 5), are preferably obtuse.

More specifically, said angles A, B are advantageously greater than or equal to 100°. In the illustrated examples, the angles A and B are about 100° and 150°, respectively.

The arch 10 has an axial extension (or height), measured axially between the seat 5 and the apex 12, denoted H. As can be seen in the drawings, and more particularly in FIGS. 4 and 8, the arch 10 is advantageously deep, i.e., the height H of the arch is not negligible with respect to the diameter d of the seat 5, the ratio H/d being greater than 0.25. In the illustrated examples, said ratio is about 0.3.

Represented in the drawings are two embodiments of the bottom.

In a first embodiment, illustrated in FIGS. 1 to 5, the arch 10 is unitary and extends continuously from the membrane 9 to the apex 12.

The arch 10 preferably has, in axial cross-section (FIG. 4), a curved profile with concavity turned towards the axis X of the container 1. In the illustrated example, the radius of curvature of the arch, denoted R0, is greater than or equal to the diameter d of the seat:

$$R0 \geq d$$

The arch 10 has an average acute angle C at the apex of between 70° and 90°. In the illustrated example (see FIG. 4), said average angle C at the apex is about 80°.

In a second embodiment, illustrated in FIGS. 6 to 10, the arch 10 is stepped and comprises two superimposed portions, i.e., a lower portion 17 of the side of the seat 5, and an upper portion 18 of the side of the apex 12.

The characteristics of the arch 10 described above according to the first example, with reference to FIGS. 2 to 5, apply to each of the lower and upper portions of the arch 10 according to the second example. In particular, the lower portion 17 and the upper portion 18 both have a star-shaped profile in cross-section inscribed between an inner circle 13 and an outer circle 14 having respective diameters D1 and D2, the ratio D1/D2 of which is greater than 0.7 (FIGS. 9 and 10).

The lower portion 17 extends from the inner edge 11 of the membrane 9 (near the seat 5) to an intermediate junction zone 19 situated about mid-height of the arch 10, and the upper portion 18 extends from the intermediate junction zone 19 to the apex 12 of the arch 10.

The lower portion 17 is substantially conical with an acute angle E at the apex, said angle E at the apex preferably being between 40° and 60°, and for example about 50°, as illustrated in FIG. 8.

With regard to the upper portion 18, it is substantially conical with an obtuse angle F at the apex, said angle F at the apex preferably being between 100° and 120°, and for example about 110°, as illustrated in FIG. 8.

The intermediate junction zone 19 (where there is an offset between the lower portion 17 and the upper portion 18) being situated at about mid-height of the arch 10, the lower portion 17 and the upper portion 18 have axial extensions (or heights), respectively denoted H1 and H2, equal or practically equal, such that:

$$H1 \cong H2 \cong \frac{H}{2}$$

Advantageously, as can be seen in FIG. 8, the lower portion 17 has, in axial cross-section, a curved profile with concavity turned towards the axis X of the container 1, while the upper portion 18 has, in axial cross-section, a curved profile with concavity turned opposite to the axis X. In other words, the concavity of the arch 10 is inverted between the lower portion 17 and the upper portion 18, at their intermediate junction zone 19.

The lower portion 17 and the upper portion 18 preferably have respective radii of curvature, denoted R1 and R2, that are of the same order of size and are comparable to the radius of the seating plane.

$$R1 \cong R2 \cong \frac{d}{2}$$

However, it is possible for the radii R1 and R2 not to be of the same order of size, but for R1 to be smaller than or equal to R2. Thus, according to a particular embodiment, the radii R1 and R2 are for example in a ratio of between 0.6 and 1:

$$0.6 \leq \frac{R1}{R2} \leq 1$$

Said arch 10 confers to the bottom 4 a good compromise between blowability and resistance to deformation.

In particular, the star shape of the arch 10 makes it possible to obtain a good axial rigidity, i.e., good resistance to compression along the axis X, the angular facets 16 acting as stiffeners and opposing a reversal of the arch 10 under the effect of the pressure inside the container 1.

However, said rigidity is not obtained at the cost of blowability, thanks to the small radial extension of the star formed by the transverse cross-section of the arch 10. The open (or obtuse) angles A, B between the facets 16, the chosen radii of curvature R0, R1, R2 as well as the dimensional ratios R1/R2 and H/d also contribute to the good blowability of the bottom 4.

The inversion of curvature in the stepped arch 10 gives the arch a greater blowability as a result of a smaller quantity of material needed to produce it. Tests have shown that a container having the arch 10 described above can be produced with significantly less blowing fluid pressure than is necessary for a container with arches according to the prior art. More specifically, while an average blowing pressure between 35 and 38 bars was necessary to produce a container with an arch of equivalent strength, the container 1 provided with the arch 10 described above can be produced by injecting a fluid at a blowing pressure on the order of 24 bars, which represents a 30% to 40% reduction. The result is reduced need of blowing fluid, and it becomes possible to use pressurized fluid production facilities of smaller size.

The manufacture of the bottom 4 of the container 1 can be advantageously produced by implementing a boxing technique, wherein the mold in which the container 1 is formed has a movable mold bottom that enables the material to be over-stretched at the bottom 4, to the benefit of a good impression and a greater rate of crystallinity (favorable to the structural rigidity of the bottom).

When a container 1 is equipped with such a bottom 4, it is especially suitable for filling with carbonated beverages, particularly beer.

The invention claimed is:

1. Container of plastic material, comprising a body extending along a principal axis and a bottom in the extension of the body at a lower end thereof, the bottom comprising:

an annular seat defining a seating plane;

a conical arch that extends from near the seat towards the interior of the container to a central apex, the conical arch comprises a series of facets, wherein that the arch has in transverse cross-section a star-shaped profile inscribed between an inner circle and an outer circle, the ratio of the diameter of the inner circle to the diameter of the outer circle is greater than or equal to 0.7, the facets, grouped in pairs, defining branches of the star-shaped profile.

2. Container according to claim 1, wherein the ratio of the diameters is between 0.8 and 0.9.

3. Container according to claim 1, wherein angles between the facets of the same branch and between two adjacent facets of two neighboring branches are obtuse in a transverse plane.

4. Container according to claim 3, wherein the angles between facets are greater than or equal to 100°.

5. Container according to claim 1, wherein the arch has two superimposed portions, that are a lower substantially conical portion at an acute angle, which extends from near the seat to an intermediate junction zone, and an upper substantially conical section at an obtuse angle, which extends from the intermediate junction zone to the apex.

6. Container according to claim 5, wherein the lower portion and the upper portion of the arch have axial extensions that are equal or practically equal.

7. Container according to claim 5, wherein the lower portion of the arch has, in axial cross-section, a curved profile with concavity turned towards the axis of the container.

8. Container according to claim 5, wherein the upper portion of the arch has, in axial cross-section, a curved profile with concavity turned opposite to the axis of the container.

9. Container according to claim 7, wherein in axial cross-section, the profiles of the lower portion and the upper portion have respective radii of curvature R1 and R2 such that the ratio R2/R1 falls between 0.6 and 1.

10. Container according to claim 1, wherein the arch has a height measured axially, in that the seat has a width measured transversely, the ratio of the height to the width being greater than 0.25.

11. Container according to claim 1, wherein the conical arch includes an edge near the seat, the edge defining an outer perimeter of the star-shaped profile and lying entirely within the inner circle and the outer circle.

12. Container according to claim 1, wherein each of the facets is planar.

13. A container comprising:

a body; and a bottom at a first end of the body, the bottom comprising:

an annular seat defining a seating plane;

a central apex at the center of the bottom; and a conical arch extending from near the annular seat to the central apex, the conical arch comprises a series of facets, wherein the arch includes in transverse cross-section a star-shaped profile, and wherein the conical arch includes an edge near the seat, the edge defining an outer perimeter of the star-shaped profile and lying entirely within an inner circle and an outer circle, the ratio of the diameter of the inner circle to the diameter of the outer circle is greater than or equal to 0.7, the facets, grouped in pairs, defining branches of the star-shaped profile.

14. Container according to claim 13, wherein each of the facets is planar.

* * * * *